United States Patent [19]

Spengler et al.

[11] Patent Number: 4,516,859

[45] Date of Patent: May 14, 1985

[54] APPARATUS FOR CLOSING A DISCHARGE OPENING IN A ROTARY TABLE

[75] Inventors: Adolf Spengler, Külsheim; Josef Hasenhündl, Ahorn, both of Fed. Rep. of Germany

[73] Assignee: Hubert, Eirich Eirich, Hardheim, Fed. Rep. of Germany

[21] Appl. No.: 341,426

[22] Filed: Jan. 21, 1982

Related U.S. Application Data

[63] Continuation of Ser. No. 110,970, Jan. 10, 1980, abandoned.

[30] Foreign Application Priority Data

Feb. 2, 1979 [DE] Fed. Rep. of Germany ..... 2903951

[51] Int. Cl.[3] ..... B28C 7/16

[52] U.S. Cl. ..... 366/77; 220/244; 220/314; 366/189; 366/192

[58] Field of Search ..... 366/42, 77, 184, 189, 366/347, 192; 220/314, 244, 243

[56] References Cited

U.S. PATENT DOCUMENTS 2,900,104 8/1959 Schmidt, Jr. ..... 220/314

2,962,186 11/1960 Gottschalk ..... 220/314

*Primary Examiner*—Timothy F. Simone

*Attorney, Agent, or Firm*—Biebel, French & Nauman

[57] ABSTRACT

An apparatus for closing a discharge opening (3) in the bottom (1) of a container, preferably a rotary mixing table of a processing machine, comprising a closure cover (4) which is arranged on a rotary shaft (5) through a support arm (6). The rotary shaft (5) and the support arm (6) are provided outside the container and adjacent the bottom thereof. A resilient means (8) is disposed between the closure cover (4) and the support arm (6) which are connected together by way of a hinge (7). Preferably the resilient means can be a rubber or plastic member which is faced with metal members (16, 19) and which is arranged between the closure cover (4) and a pivot bearing (9). The pivot bearing (9) is secured to the support arm (6) and has a bearing plate (11) with screw threaded bores (13, 14) for mounting at least one pressure screw (15) and an adjusting screw (17).

6 Claims, 3 Drawing Figures

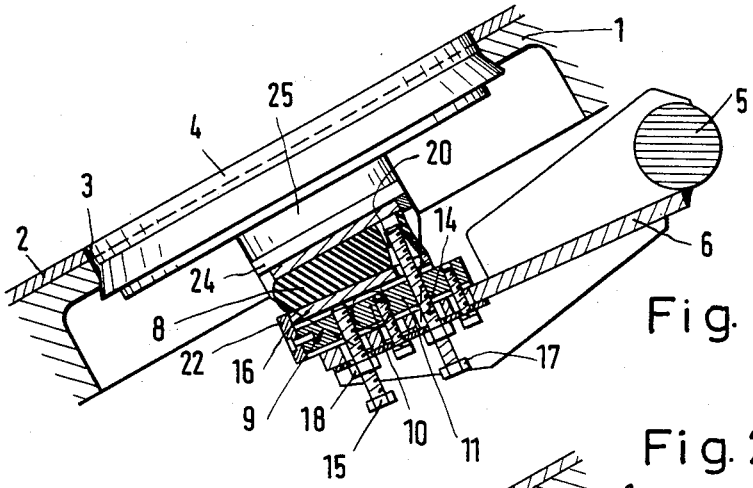
Fig. 1
Fig. 2
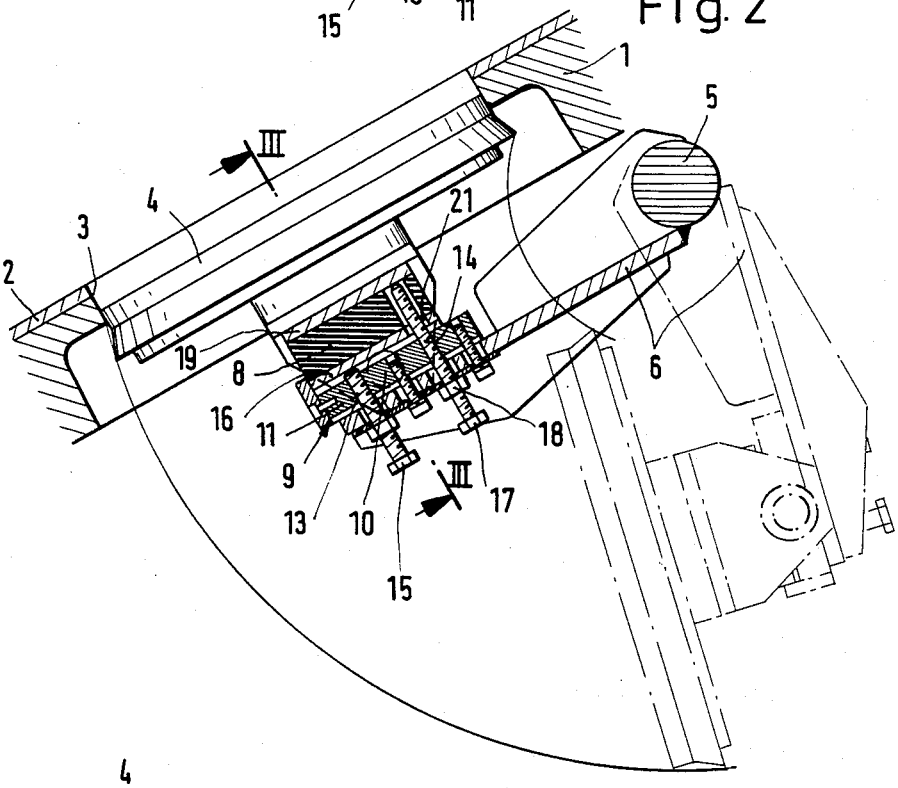
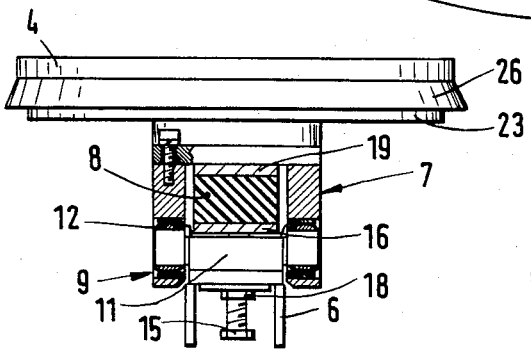
Fig. 3

APPARATUS FOR CLOSING A DISCHARGE OPENING IN A ROTARY TABLE

This is a continuation of application Ser. No. 110,970 filed Jan. 10, 1980, abnd.

The invention relates to apparatus for closing a discharge opening arranged in the bottom of a container, preferably a rotary table of a processing machine, having a closure cover which is arranged on a rotary shaft by way of a support arm, wherein the rotary shaft and the support arm are provided outside the container and adjacent the bottom thereof.

Closure arrangements of the above-indicated kind, in particular for mixing machines with a rotary plate or table, are basically known. In these arrangements however, the closure cover is always rigidly connected to the support arm and the rotary shaft. In such an arrangement, the closure cover then necessarily performs a circular movement about the rotary shaft. A disadvantage with this construction is that the closure cover can be inserted into the discharge opening in the bottom of the container, only when there is considerable clearance between the outside diameter of the closure cover and the inside diameter of the discharge opening, so that the horizontal component of the circular movement can be absorbed in the gap formed by the difference between the above-mentioned diameters. In this construction however, the gap results disadvantageously in a serious loss of sealing action so that it is not possible for liquid or fine-grain materials to be processed in a container which is closed in this way.

Attempts have already been made to counter this difficulty by providing a flat sealing ring of rubber on the underside of the closure cover, the rubber sealing ring covering the gap downwardly and outwardly of the container. Although this construction already provides an improvement over the first-mentioned known structure, nonetheless there is still the problem that material (which is for example unmixed) is deposited in the gap which is still present, and that jamming can occur when processing coarse-grained material (for example fine broken concrete). The sealing action is also insufficient for processing liquid material, because the rubber sealing ring only lies against the underside of the bottom of the container, on the outside thereof, and cannot be drawn into a fixed sealing seat, by virtue of the horizontal components of movement.

A further disadvantage is that, when the container bottom is of greater thickness, the vertical component of movement is correspondingly greater than when the container bottom is thinner, so that the width of gap which then occurs is no longer acceptable for proper operation. On the other hand, in some use situations, it is necessary for the container bottom to be of greater thickness, in particular in the case of larger machines, for static reasons, or for the container bottom to be clad with additional wear plates or other covering means, for examples tiles of fused basalt, cast tiles etc. In addition, a sufficiently large sealing surface should still be available at the lower edge of the opening. Container bottoms which are of the above-described thickness cannnot be closed off, or cannot be closed off satisfactorily, by the above-described known arrangements, which are also referred to as flap closures.

A flap closure is also known, on mixing machines, wherein the circular movement as it passes into the bottom of the container is converted into a linear movement by a parallel guide means. From the mechanical engineering point of view, this construction is disadvantageous in that it is very expensive, and requires the machine to be of large structural height, while also requiring extensive maintenance and routine repair work, especially as this mechanism, with its pivot bearings, is moved in a space through which flows the material issuing from the mixing container.

An expensive pivot closure means has also been developed, in order to overcome the problems of the known flap closure. In the pivot closure means thus developed, the support arm pivots the closure cover about a vertical, that is to say, perpendicular shaft, from a region outside directly below the discharge opening in the bottom of the container. Thereupon, a vertical lifting movement is initiated for inserting the closure cover into the discharge opening. Although these pivotal closures means are satisfactory from the point of view of operation, the cost and the amount of maintenance required are unacceptably high. By virtue of the vertical and additionally horizontal movements required, either the arrangement must have two drive systems, or there must be a complicated lever system which provides for converting the horizontal component of movement into the vertical component. In addition, pivotal closure means of this kind, below the machine, disadvantageously require a considerable amount of space for allowing the pivotal movement to be effected. This pivotal movement must be so great that the closure cover can be pivoted completely out of the region of the discharge opening.

The problem of the present invention is therefore to provide a closure apparatus of the above-indicated kind, which, in spite of being of simple construction and enjoying favourable installation conditions, provides a reliable closure action, with a considerably improved seal.

According to the invention, this problem is solved in that a resilient means is disposed between the closure cover and the support arm which are connected together by way of a hinge. For the first time in this art, this apparatus provides for a flexible arrangement of the closure cover on the support arm, without impairing the robust construction and maintenance-free reliable operation. In fact, advantageously, the first part of the closing movement is still performed by means of a normal circular movement in which the support arm is moved over a circular arc by the driven rotary shaft. However, as soon as the closure cover reaches the centering ring of the discharge opening at the bottom of the container and butts thereagainst, the resilient means comes into action, and permits the closure cover to be deflected from its circular movement so that the closure cover slides into the discharge opening perpendicularly to the closure cover, while the support arm which carries the cover concludes the circular movement. Therefore, the resilient means compensates for the difference in the direction of movement between the centering ring or inside edge of the discharge opening on the one hand, and the outside edge of the closure cover on the other hand. The structure of the rigid support arm which is secured to the rotary shaft, such structure being known from the state of the art, can be retained because, from the point of view of function, the resilient means is only arranged after the support arm, that is to say, between the support arm and the closure cover.

In an advantageous development of the invention, the resilient means is a rubber or plastics member which is faced with metal members and which is arranged between the closure cover and a pivot bearing. A resilient means of this kind is sometimes referred to as a 'vibration damping connector' and is in the form of a cube or square block which internally has a compressible elastic plastics or rubber body which is sheathed at at least two oppositely disposed surfaces with the above-mentioned metal members, for example with a laminated sheet metal assembly or a thicker iron sheet member. The metal sheathing on the two outer surfaces gives good mechanical engagement means which are also used in accordance with the invention in the resilient means.

The pivot bearing permits movement of one metal plate of the resilient means relative to the other metal plate, although obviously both plates are fixedly connected together, with the exception of the above-described possibility of pivoting movement, for example by way of mounting limb or web portions, as will be described hereinafter. The resilient means used could also be a spring or a hydraulic or pneumatic bellows assembly.

By virtue of the resilient means on the pivot bearing, the closure cover is virtually connected to the support arm by way of a hinge which permits the pivot movement, as mentioned above, in the required direction. Preferably, an in order to simplify the bearing components on the pivot bearing, pivotal movement is permitted in only a single direction. In a preferred embodiment, the pivot axis is parallel to the axis of the rotary shaft, and on the outside the pivot bearing has so-called radial ball-and-socket joints.

It is also advantageous, in accordance with the invention, for the pivot bearing to be secured to the support arm, and to have a bearing plate with screwthreaded bores for mounting at least one pressure screw and adjusting screw. The bearing plate connects the two radial ball-and-socket joints and lies in the form of at least one web portion or plate on the side of the closure cover which is opposite to the resilient means. By virtue of this arrangement, the pressure and adjusting screws can exert their full action on the resilient means on the one hand and the closure cover on the other hand.

Any pulling forces which may be required when opening the closure cover, that is to say, when pulling the closure cover out of the discharge opening, are transmitted by way of the pivot bearing, the bearing plate and the bearing web portions, from the closure cover—except for the above-described possibility of pivotal movement—rigidly to the support arm. This arrangement therefore provides all the advantages of the robust rigid mounting of the known flap closure means but nonetheless, by virtue of the features according to the invention, advantageously provides for a good sealing action because the gap as a result of the different between the outside diameter of the closure cover and the inside diameter of the discharge opening can be made considerably smaller than in the known constructions.

According to the invention, an advantageous development provides that the pressure screw is held pressed against the side of the resilient means which is remote from the closure cover, the resilient means having a blind bore for the passage therethrough of the adjusting screw which is held pressed against the metal reinforcement secured to the closure cover, or against a pressure plate of the resilient means. Therefore the pressure screw can be very easily used to adjust the presttess at the resilient means. For example, tightening down the pressure screw causes compression of the resilient body which is disposed between the metal members, so that the action of the resilient means becomes harder. When the pressure screw is screwed out, then obviously the effect is the opposite.

The adjusting screw is used to adjust the closure cover, in particular at the beginning of the vertical movement. Adjustment of this kind is desirable so that the closure cover is parallel to the bottom of the container, in the closed condition.

Abutment screws may also be provided, or the adjusting screws may take over the function of abutment screws, in order to establish limit positions in respect of the resilient means so that forces which occur, for example when material is jammed during the closing operation, do not overload the resilient means.

It is also advantageous in accordance with the invention for the closure cover to have a rotary bearing trunnion mounted in a rotary bearing, in the middle region, and to have a sealing ring, on the outside. The provision of the sealing ring means that the annular gap which can be set to an extremely narrow value by virtue of the features according to the invention, can even be sealed off so as to be fluid-tight, by virtue of the rotary bearing and the rotary bearing member, even for a closure cover which also rotates. Therefore, this opening means is also particularly attractive in relation to positive mixers with a rotating container.

Further advantages, features and possible uses of the present invention are set forth in the following description with reference to the drawings in which:

FIG. 1 shows a broken away view, partly in section, of the closure apparatus, with the closure cover being held pressed into the discharge opening, FIG. 2 shows a view similar to that of FIG. 1, the solid lines showing the condition of the apparatus at the beginning of the circular movement, after the closure cover has been pulled out of the discharge opening, while the dash-dotted lines show the opened condition after the rotary movement, and FIG. 3 shows a partly broken away detail view along line III—III in FIG. 2.

The container bottom 1 shown in FIGS. 1 and 2 is faced on its surface with an armour lining 2. This results in a not inconsiderable thickness of material in the discharge opening 3 so that the closure cover 4 whose suface must lie flush with the surface of the lining 2 of the container bottom 1 must carry out a not inconsiderable vertical component of movement, as well as the above-described circular movement along the arcuate line shown in FIG. 2.

The embodiment of structure shown herein is a positive mixer whose rotary table axis is not vertical but is tilted out of the vertical by an angle of for example 30°. Therefore the bottom 1 in FIGS. 1 and 2 is shown at an inclined angle. The container which is in the form of a rotary table extends upwardly so that the arrangement shown herein is disposed outside the container and below it.

The support arm 6 is secured to the rotary shaft 5 which is rotatably mounted and driven on the machine frame (not shown). At its free end, the support arm 6 carries the closure cover 4 by way of the hinge 7 (see FIG. 3), the resilient means 8 and the pivot bearing 9.

With the exception of the pivotal movement about the pivot axis 10 (FIGS. 1 and 2), the closure cover 4 and the support arm 6 are rigidly connected to the pivot bearing 9 by way of the hinge 7. The pivotal movement is permitted by the pivot bearing 9 having ball-and-socket joints which are only shown in FIG. 3, on the outside, at the oppositely disposed ends of a bearing plate 11. It will thus be seen that, as shown in FIG. 3, the closure cover 4 can be pivoted not in the plane of the paper but perpendicularly thereto, namely about the pivot axis 10 which is parallel to the axis of the rotary shaft 5.

FIG. 1 moreover shows the operating position in which the pivot bearing 9 is pivoted, compressing the left-hand half of the rubber or plastics member. FIG. 2 shows the apparatus in the unloaded condition.

The bearing plate 11 of the bearing 9 has screwthreaded bores 13 and 14 which can only be seen in the sectional views shown in FIGS. 1 and 2. The pressure screw 15 is held pressed against the outer metal member 16 and the adjusting screw 17 (both secured by lock nuts 18) is held pressed against the pressure plate 24 through the inner metal member 19 of the resilient means 18. It will also be seen that the middle rubber portion of the resilient means 8 has a bore 20 which is extended in line with the bore 21 in the outer metal member 16, to receive the adjusting screw 17. This thus provides blind bore 20, 21 in the resilient means 8.

At the left-hand end in FIGS. 1 and 2, a bar 22 is screwed to the plate 11 of the bearing 9, in order to mount and guide the resilient means 8. The rubber ring 26 on the outer periphery of the closure cover 4, which is secured by means of a pressure ring 23, can be clearly seen in FIG. 3.

The drawing does not show the construction of a closure cover which is driven positively, preferably at a variable speed of rotation. The drive is so secured to the closure cover that it also follows the defelction movement.

In operation, after the closure apparatus has been installed, the resilient means 8 is first subjected to a pre-stressing, by tightening the pressure screw 15. Then, by turning in the adjusting screw 17, the closure cover 4 is set in such a position that, upon reaching the position shown in solid lines in FIG. 2, that is to say, at the transition from the linear to the rotary movement, the free outer end of the screw 17 just lies against the inner metal member 19, as shown in FIG. 2. This ensures that the surface of the closure cover 4 is actually parallel to the surface of the bottom 1 of the container. Reference 25 denotes the mounting sleeve for the closure cover 4.

From the position shown in dash-dotted lines in FIG. 2, after actuation of the drive (not shown) by rotating the shaft 5, the support arm 6 is moved along the arcuate path into the position shown in solid lines in FIG. 2. On the side which is towards the shaft 5, the closure cover 4 butts against the inner edge of the discharge opening 3, and now begins the translatory movement in the direction of the axis of rotation of the rotary table, the bottom of which is shown at 1. When this happens, the resilient means 8 is compressed at the left, and stretched somewhat at the right (as shown). This occurs when the closure cover 4 is pressed in, until reaching the position shown in FIG. 1.

We claim:

1. A rotary closure apparatus for closing a discharge opening in a container, comprising:

a shaft supported on said container for rotation abouts its longitudinal axis;

a support arm rigidly connected to said shaft for rotation therewith;

a closure cover carried by said support arm for closing or opening said discharge opening upon rotation of said shaft;

pivot bearing means for rigidly interconnecting said closure cover to said support arm for relative pivotal movement therebetween about a single axis disposed transverse to said discharge opening; and resilient means engaging said support arm and said closure cover for yieldably supporting said closure cover in a desired position relative to said support arm so that said closure cover can pivot about said single axis upon application of a force thereto but will return to said desired position upon removal of said force.

2. Apparatus as defined in claim 1, including:

said resilient means comprising an elastomeric resilient member;

a pair of metal plates sandwiching said resilient member, a first said plate being secured to said closure cover and a second said plate engaging but not secured to said support arm;

a pressure screw threadedly received in said support arm and engaging said second plate for prestressing said resilient member; and an adjusting screw threadedly received in said support arm and engaging said first plate for aligning said closure cover for initial entry into said discharge opening.

3. The apparatus of claim 2 wherein said closure cover carries a sealing ring mounted about its circumference.

4. The apparatus of claim 3 wherein said closure cover and resilient member are pivotally mounted on said support arm by a rotary trunnion mounted on a rotary bearing.

5. The apparatus of claim 3 wherein said discharge opening is cylindrical.

6. A rotary closure apparatus for closing a discharge opening in a container, comprising:

a closure cover;

a support arm to which said closure cover is mounted;

a shaft rotatably supporting said support arm;

a pivot bearing interconnecting said closure cover and said support arm for relative pivotal movement of said closure cover with respect to said support arm about a single axis; and a resilient member interconnecting said closure cover and support arm for yieldably supporting said closure cover on said support arm for said pivotal movement about said single axis for alignment with said discharge opening of said container, wherein said single axis is parallel to the axis of rotation of said shaft and transverse to said discharge opening.

* * * * *

UNITED STATES PATENT AND TRADEMARK OFFICE

CERTIFICATE OF CORRECTION

PATENT NO. : 4,516,859

DATED : May 14, 1985

INVENTOR(S) : Adolf Spengler, Josef Hasenhündl

It is certified that error appears in the above-identified patent and that said Letters Patent is hereby corrected as shown below:

On the title page;

Item [73] Assignee: "Hubert, Eirich Eirich" should be -- Hubert Eirich, Paul Eirich and Walter Eirich --.

Col. 6, claim 1, line 3, "abouts" should be -- about --.

Signed and Sealed this

*Twenty-ninth* Day of *October 1985*

[SEAL]

*Attest:*

*Attesting Officer*

DONALD J. QUIGG

*Commissioner of Patents and Trademarks—Designate*